US008975606B2

(12) United States Patent
Bowers

(10) Patent No.: US 8,975,606 B2
(45) Date of Patent: Mar. 10, 2015

(54) FINGER-MOUNTED ILLUMINATING DEVICE

(71) Applicant: Paul Bowers, Reno, NV (US)

(72) Inventor: Paul Bowers, Reno, NV (US)

( * ) Notice: Subject to any disclaimer, the term of this patent is extended or adjusted under 35 U.S.C. 154(b) by 0 days.

(21) Appl. No.: 14/227,838

(22) Filed: Mar. 27, 2014

(65) Prior Publication Data

US 2014/0291556 A1 Oct. 2, 2014

Related U.S. Application Data

(60) Provisional application No. 61/806,343, filed on Mar. 28, 2013.

(51) Int. Cl.

| | |
|---|---|
| ***F21V 21/08*** | (2006.01) |
| ***F21L 4/00*** | (2006.01) |
| ***F21V 23/04*** | (2006.01) |
| *F21V 31/00* | (2006.01) |
| *F21Y 101/02* | (2006.01) |

(52) U.S. Cl.

CPC . *F21L 4/00* (2013.01); *F21V 31/00* (2013.01); *F21V 21/0816* (2013.01); *F21V 23/0414* (2013.01); *F21Y 2101/02* (2013.01)

USPC ..... 250/504 R; 362/103; 362/109

(58) Field of Classification Search

USPC ..... 250/504 R

See application file for complete search history.

(56) References Cited

U.S. PATENT DOCUMENTS

| | | | | |
|---|---|---|---|---|
| 5,124,892 | A * | 6/1992 | Lambert | 362/103 |
| 6,082,872 | A * | 7/2000 | Ting | 362/205 |
| 7,703,937 | B2 * | 4/2010 | Shirey | 362/103 |
| 2006/0007669 | A1 * | 1/2006 | Blackburn | 362/103 |

* cited by examiner

*Primary Examiner* — Phillip A Johnston

(74) *Attorney, Agent, or Firm* — Mark A. Goodman, Esq.

(57) ABSTRACT

A finger-mounted illuminating device is disclosed. This device specifically addresses the problem of maintaining hands-free capability in a low or no light environment. This embodiment is a compact structure made of sturdy plastic or other material, which is mounted to the finger(s) and contains various types of illumination output, power source, thumb activated button(s), and circuits to manipulate the illumination needs as required by the operator.

19 Claims, 5 Drawing Sheets

FINGER-MOUNTED ILLUMINATING DEVICE

CLAIM TO PRIORITY OF EARLIER FILED APPLICATION(S)

This Application claims the benefit of U.S. Provisional application No. 61/806,343 filed on Mar. 28, 2013.

CROSS-REFERENCE TO EARLIER FILED APPLICATION(S)

The disclosure of U.S. Provisional application No. 61/806,343 filed on Mar. 28, 2013 is incorporated herein by reference in its entirety.

FIELD OF THE INVENTION

The present invention relates to a hands-free illumination device that attaches to the fingers, thus leaving the hands free to perform other tasks.

BACKGROUND OF THE INVENTION

Small portable illumination devices have been a part of the field since the turn of the last century. The problem with these devices is that most must be held by the operator's hand, thus occupying one hand and leaving the other hand to perform a task. This can be awkward for the person using the device. Situations exist where the user doesn't have the luxury of dedicating one hand for illuminating, leaving one hand to perform a task. This embodiment frees the hand to be unhindered and available to complete the work at a higher level of efficiency.

This device has multiple uses for professionals as well as non-professionals. Professionals that would benefit from this device may include, but are not limited to: first responders, such as police, paramedics, and military personnel. Other professionals using the device may include maintenance workers, such as building inspectors, plumbers, electricians, or other professionals, such as delivery personnel, security guards, ushers, etc.

Personal uses may include, but are not limited to: senior citizens (for example those using a walker or cane), handicapped individuals (for example an arm amputee), campers or other outdoorsmen, as well as homeowners. Other uses of this embodiment are ideal in poorly lit environments where safety is an issue. Other uses may include walking while carrying a box or a bag of groceries, as this configuration affords the user a well-lit pathway, or performing home repairs in a low-light environment.

Various illuminating devices have been proposed in the prior art. Many of these are ornamental in nature as in U.S. Pat. Des. 300,260 by Segeren (Mar. 14, 1989), or bulky as in wrist-mounted power sources as in U.S. Pat. No. 5,448,458 by Smyly, Jr. (Sep. 5, 1995), or are of a glove type, which are inconvenient and cumbersome as in U.S. Pat. No. 6,892,397 by Raz et al. (May 17, 2005.)

Even as early as the 1900s a few inventors have come up with finger-mounted electric lamps but they are very bulky in nature as in U.S. Pat. No. 674,770 by Hull (May 21, 1901) and U.S. Pat. No. 914,975 by Radley (Mar. 9, 1909).

One prior art describes a utilitarian-type ring with an integrated lamp socket and bulb and arcuate batteries that were contained within the circumference of the ring as in U.S. Pat. No. 4,012,629 by Simms (Mar. 15, 1977). The Simms invention does not allow for forward illumination, thus limiting the field of vision.

Another prior art describes a reading light ring with an LED as the source of illumination on the palm side of the hand and also is operated by means of a thumb-operated switch as described in U.S. Pat. No. 7,703,937 B2 by Shirey (Apr. 27, 2010). The Shirey device does not allow for forward illumination, thus limiting the field of vision.

SUMMARY OF THE INVENTION

One compact illuminating embodiment designed to be hands-free that attaches to the user's finger(s) via a strap or molded ring at the proximal phalanx bone of the index and middle fingers. The embodiment is a convenient and compact structure composed of a strong, lightweight material, and contains within an illumination source directed forward to maximize and improve the field of vision, a power source, and an ergonomically-located energizing button within easy reach of the thumb.

ADVANTAGES OF THE INVENTION

Accordingly, several advantages of one or more aspects are, as follows: to provide hands-free forward directed illumination while leaving the operator's hand available to perform a task. The embodiment is utilitarian, compact, and novel. Also, different types of light in different combinations make it versatile, as well, as there may be multiple combinations of light and circuitry to meet user needs. For example, white light and UV light for forensics, white light and infrared for the military and pilots, or white light and a laser pointer for presentations. Other advantages of one or more aspects will be apparent from a consideration of the drawings and ensuing descriptions.

DETAILED DESCRIPTION OF THE INVENTION

Figure 1:
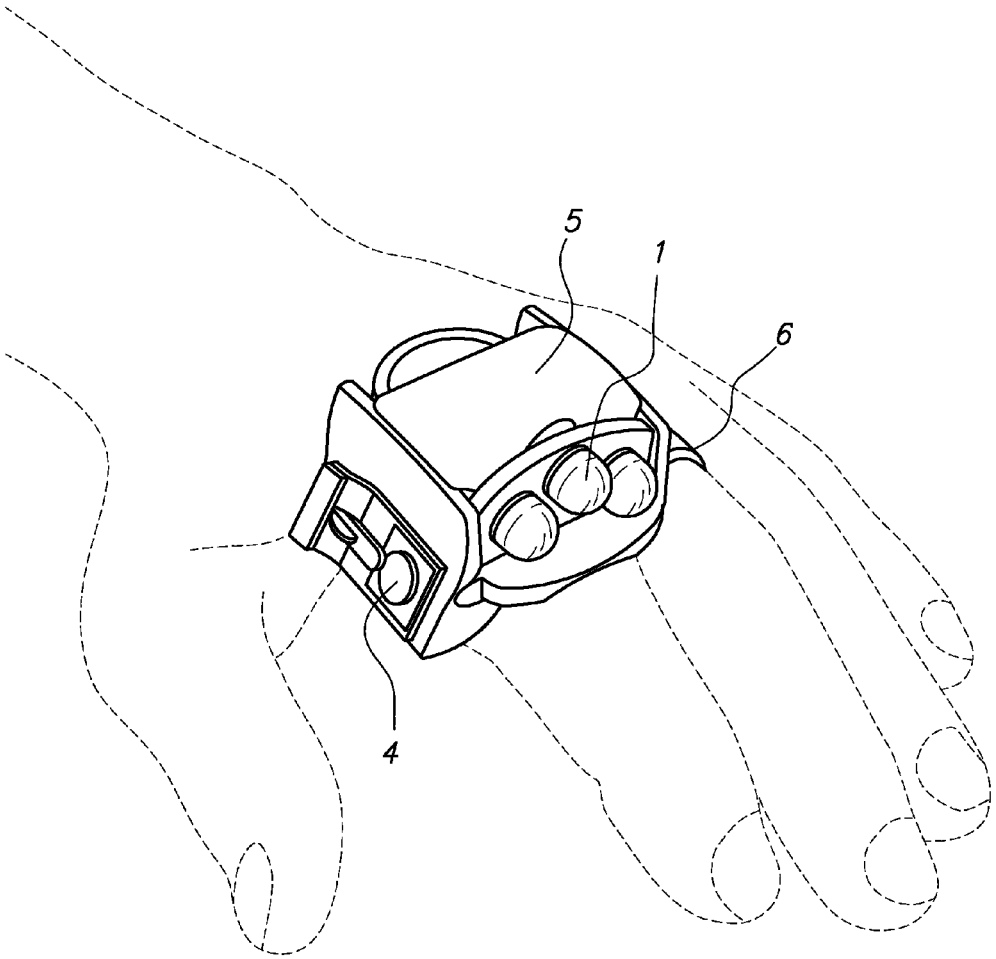
FIG. 1 is substantially a top perspective of the preferred embodiment of the present invention.
Figure 2:
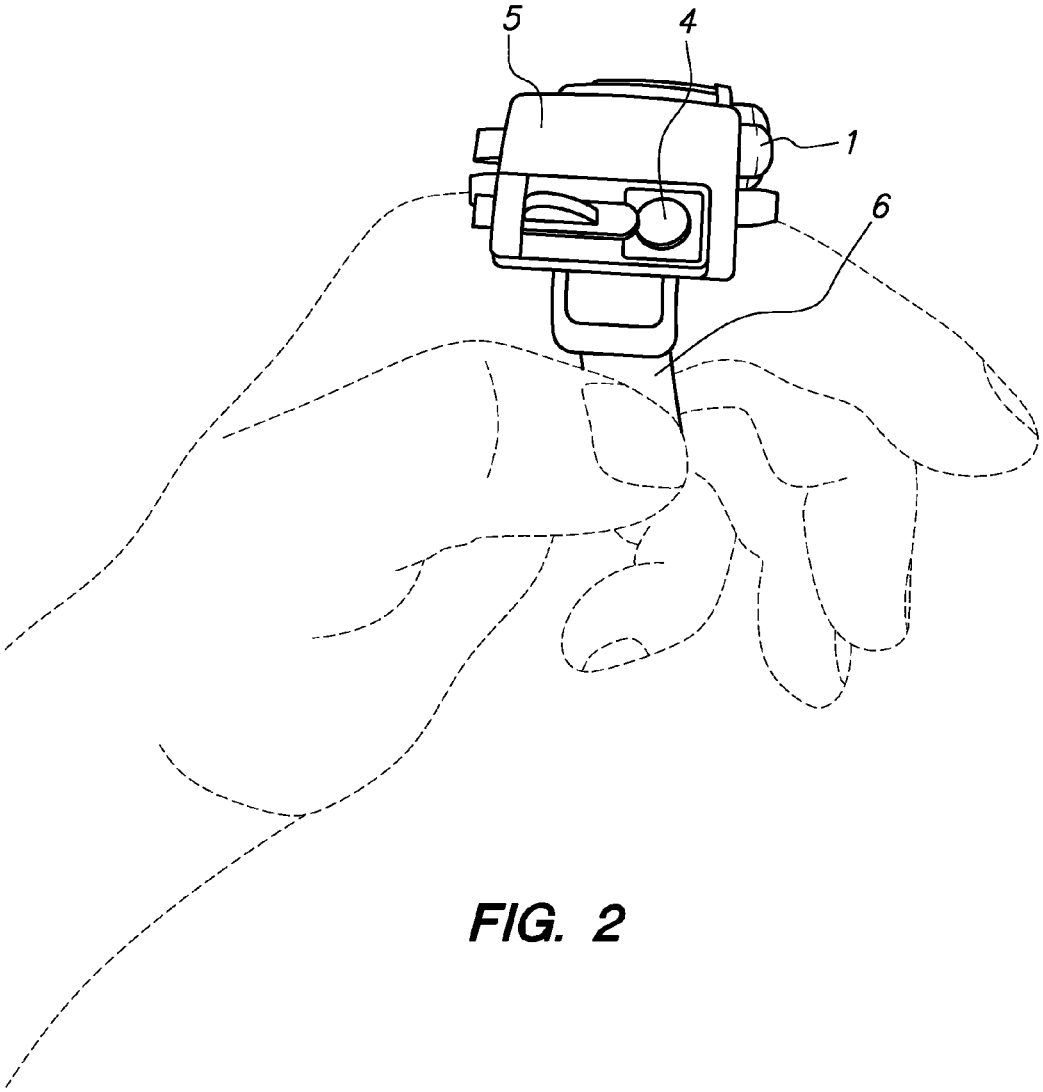
FIG. 2 is substantially a side perspective of the preferred embodiment of the present invention.
Figure 3:
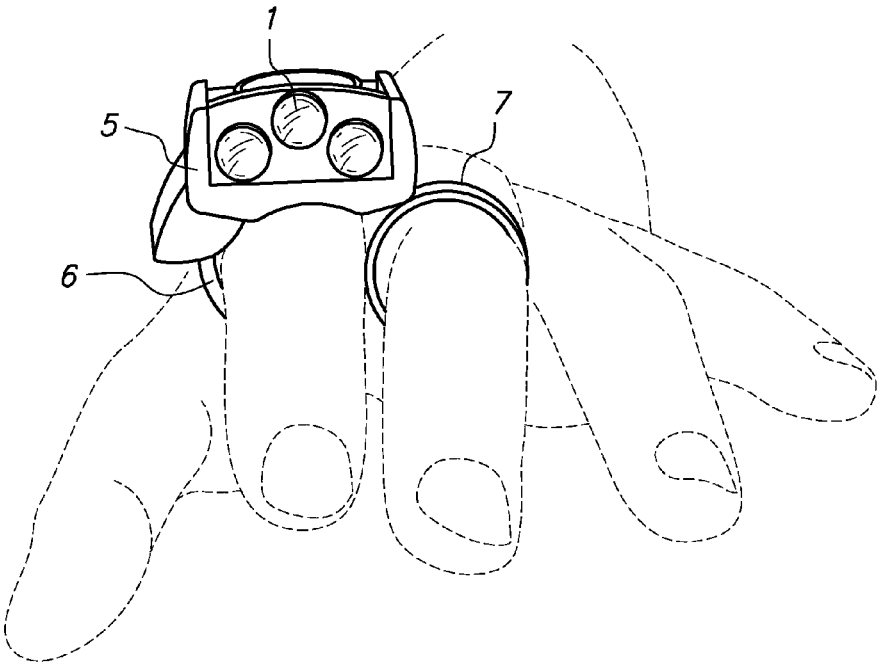
FIG. 3 is substantially an end perspective of the preferred embodiment of the present invention.
Figure 4:
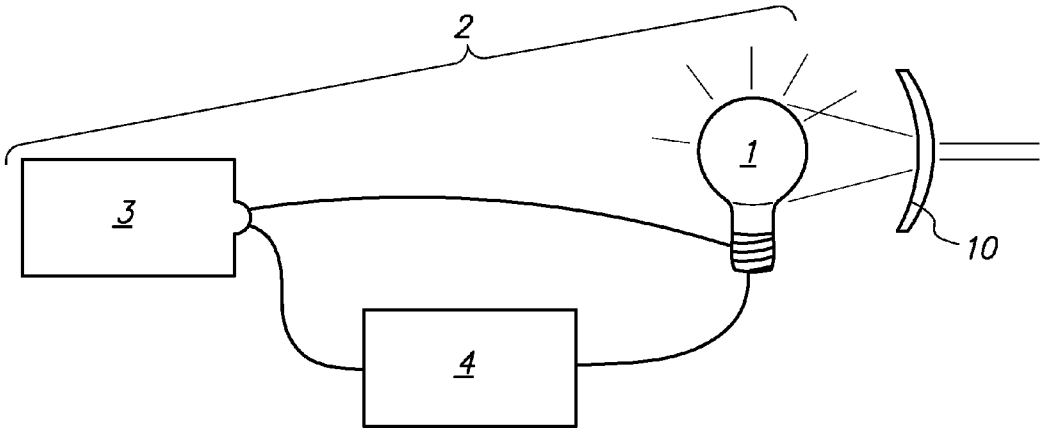
FIG. 4 is substantially a circuit diagram for the preferred embodiment of the present invention.
Figure 5:
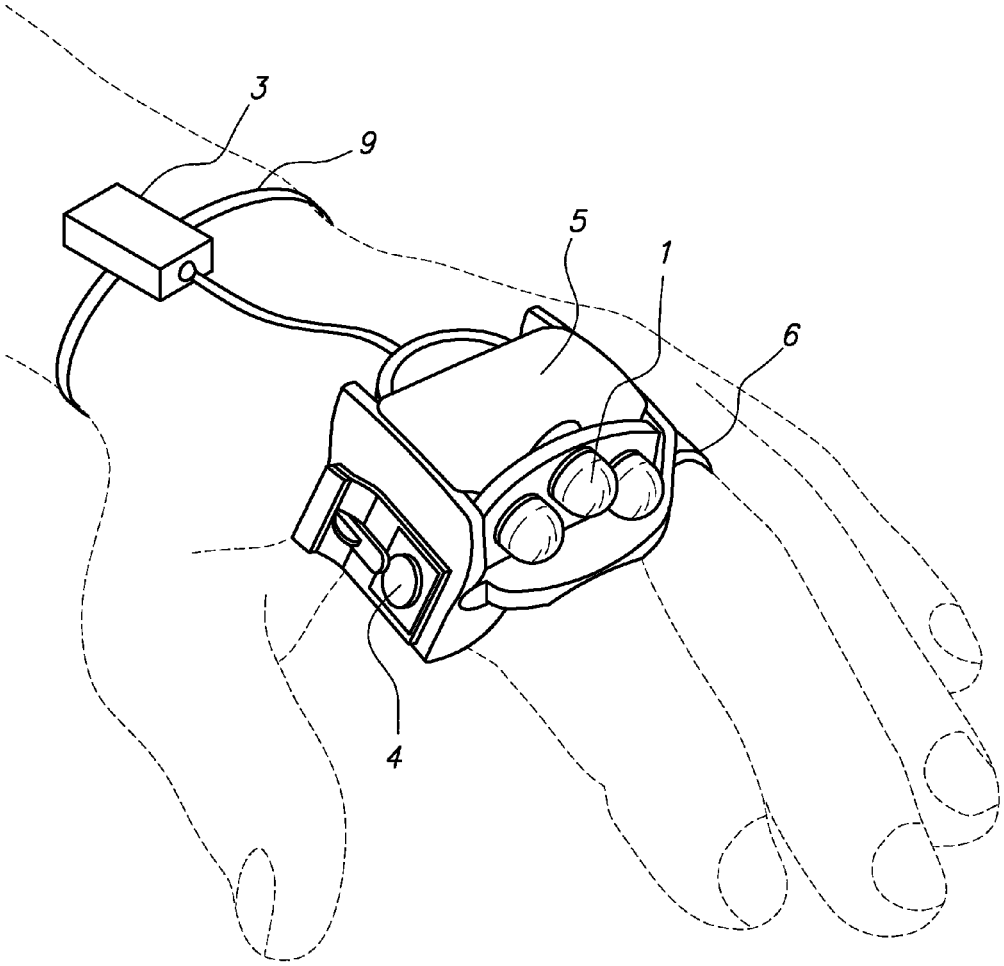
FIG. 5 is substantially a top perspective of the power supply for the preferred embodiment of the present invention.
Figure 6:
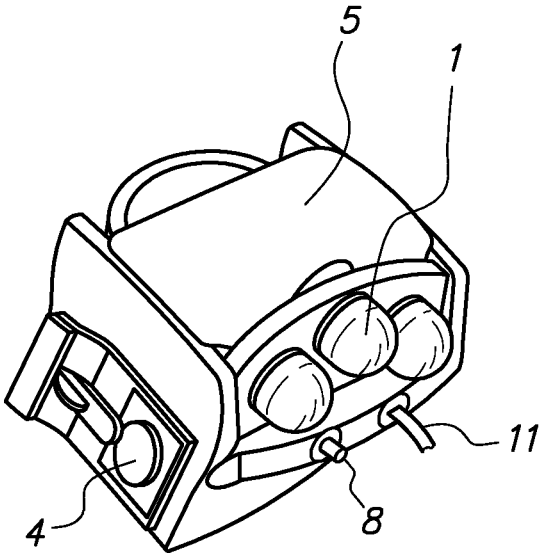
FIG. 6 is substantially a top perspective of the breakaway pins for the power supply of the preferred embodiment of the present invention.

In the following detailed description of the preferred embodiment, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The following is a listing of the reference numbers included in the original drawings and the element that each reference number corresponds to and a brief description:

FIG. 1:

1. Light Emitting Element. The Light Emitting Element 1 is mounted to the Base Member 5 in the preferred embodiment.

4. Switch. The Switch 4 is coupled to the Circuit 2 and is positioned on the first lateral side of the Base member 5, thereby allowing the Switch 4 to be actuated by the thumb of the hand in the preferred embodiment.

5. Base Member. The Base Member 5 is connected to the Light Emitting Element 1, and in the preferred embodiment the Base Member 5 has a top side, a first lateral side, a second lateral side, and a semi-cylindrically curved underside

6. First Strap. In the preferred embodiment, the First Strap 6 is connected to the Base Member 5 such that the First Strap 6, together with the semi-cylindrically curved underside of the Base Member 5, form a first loop, the first loop being sized to the index finger of a hand.

FIG. 2:

1. Light Emitting Element. The Light Emitting Element 1 is mounted to the Base Member 5 in the preferred embodiment.

4. Switch. The Switch 4 is coupled to the Circuit 2 and is positioned on the first lateral side of the Base member 5, thereby allowing the Switch 4 to be actuated by the thumb of the hand in the preferred embodiment.

5. Base Member. The Base Member 5 is connected to the Light Emitting Element 1, and in the preferred embodiment the Base Member 5 has a top side, a first lateral side, a second lateral side, and a semi-cylindrically curved underside

6. First Strap. In the preferred embodiment, the First Strap 6 is connected to the Base Member 5 such that the First Strap 6, together with the semi-cylindrically curved underside of the Base Member 5, form a first loop, the first loop being sized to the index finger of a hand.

FIG. 3:

1. Light Emitting Element. The Light Emitting Element 1 is mounted to the Base Member 5 in the preferred embodiment.

5. Base Member. The Base Member 5 is connected to the Light Emitting Element 1, and in the preferred embodiment the Base Member 5 has a top side, a first lateral side, a second lateral side, and a semi-cylindrically curved underside

6. First Strap. In the preferred embodiment, the First Strap 6 is connected to the Base Member 5 such that the First Strap 6, together with the semi-cylindrically curved underside of the Base Member 5, form a first loop, the first loop being sized to fit the index finger of a hand.

7. Second Strap. In the preferred embodiment, the Second Strap 7 is connected to the second lateral side of the Base Member 5, such that the Second Strap 7 forms a second loop sized to fit the middle finger of a hand.

FIG. 4:

1. Light Emitting Element. The Light Emitting Element 1 is mounted to the Base Member 5 in the preferred embodiment.

2. Circuit. In the preferred embodiment, the Circuit 2 consists of a Light Emitting Element 1, a Portable Power Supply 3, and a Switch 4.

3. Portable Power Supply. In the preferred embodiment, the Portable Power Supply 3 comprises a battery, is coupled to the Circuit 2, and is configured to provide electricity to the Circuit 2. The Portable Power Supply 3 is connected to the Light Emitting Element 1 on one side and to the Switch 4 on the other side.

4. Switch. In the preferred embodiment, the Switch 4 is coupled to the Circuit 2, and the Switch 4 is connected to the Light Emitting Element 1 on one side and to the Portable Power Supply 3 on the other side.

FIG. 5:

3. Portable Power Supply. In the preferred embodiment, the Portable Power Supply 3 is attached to a Third Strap 9, which is configured to secure the Portable Power Supply 3 to a wrist of the user, thereby allowing a larger Portable Power Supply 3 to be utilized by the user.

9. Third Strap. In the preferred embodiment, the Third Strap 9 secures the Portable Power Supply 3 to a wrist of the user, thereby allowing a larger Portable Power Supply 3 to be utilized by the user.

FIG. 6:

8. First Breakaway Pin. In the preferred embodiment, the First Breakaway Pin 8 is coupled to a connection point between the Base Member 5 and the First Strap 6.

11. Second Breakaway Pin. In the preferred embodiment, the Second Breakaway Pin 11 is coupled to a connection point between the Base Member 5 and the Second Strap 7.

DISCLAIMER

Although the present invention has been explained in relation to its preferred embodiment, it is to be understood that many other possible modifications and variations can be made without departing from the spirit and scope of the present invention.

What is claimed is:

1. An illumination device comprising:

a. a light emitting element;

b. a circuit;

c. a portable power supply;

d. a switch;

e. a base member, the base member having:

i. a semi-cylindrically curved underside;

ii. a first lateral side and a second lateral side;

iii. a top side;

f. a first strap connected the base member such that the first strap together with the semi-cylindrically curved underside together form a first loop, the first loop being sized to fit the an index finder of a hand;

g. a second strap connected to the second lateral side of the base member, the second being a complete second loop, the second loop being sized to fit an middle finger of a the hand;

h. wherein the light emitting element is mounted to the base member;

i. the circuit is coupled to the light emitting element;

j. the portable power supply is configured to provide electricity to the circuit;

k. the switch is coupled to the circuit;

l. the switch is positioned on the first lateral side of the base member thereby allowing the switch to be actuated by a thumb of the hand.

2. The device of claim 1, further comprising a first breakaway pin coupled to a connection point between the first strap and the base member and a second breakaway pin coupled to a connection between the second strap and the base member.

3. The device of claim 1, wherein the base member is made of molded plastic.

4. The device of claim 1, wherein the portable power supply comprises a battery and the battery is mounted to the base member.

5. The device of claim 1, wherein the switch comprises a momentary switch.

6. The device of claim 1, wherein the switch comprises an on/off switch.

7. The device of claim 1, wherein the circuit includes both a momentary and an on/off functions present in the same switch.

8. The device of claim 1, wherein the first and second straps are made of elastic fabric.

9. The device of claim 1, wherein the light emitting element is selected from the group consisting of: a light emitting diode, an incandescent light, a laser, a black light, an infrared lamp, a strobe light, and an ultraviolet light.

10. The device of claim 7, further comprising a second light emitting element mounted to the base member, wherein the first light emitting element comprises an infrared lamp and the second light emitting element comprises a light emitting diode wherein the circuit is configured such that a double click of the switch alternates from the first light emitting element to the second light emitting element.

11. The device of claim 1, further comprising a second circuit, a second light emitting device, and a second switch; wherein all of the above elements are connected to the base member.

12. The device of claim 1, further comprising a third strap configured to secure the portable power supply to a wrist thereby allowing a larger portable power supply to be utilized.

13. The device of claim 1, wherein the light emitting device comprises a laser pointer optimized for presentations.

14. The device of claim 1, wherein the device is waterproof.

15. The device of claim 1, including a separate second circuit having the same elements as the first circuit.

16. The device of claim 15, including a third separate circuit.

17. The device of claim 1 wherein:

a. the light emitting element defaults to infrared;

b. the switch is configured such that a double click holds the light emitting element in an on position emitting infrared;

c. the switch is further configured such that a triple click causes the light emitting element to emit white light, thereby optimizing the device for military applications.

18. The device of claim 1, wherein the light emitting element is removable and replaceable.

19. The device of claim 1, further comprising one or more light focusing elements configured to focus the light emitted by the light emitting element.

* * * * *